US006631971B2

(12) United States Patent
Adkins et al.

(10) Patent No.: US 6,631,971 B2
(45) Date of Patent: Oct. 14, 2003

(54) INKJET PRINTER AND METHOD FOR USE THEREOF

(75) Inventors: Christopher Alan Adkins, Lexington, KY (US); Mark Joseph Edwards, Lexington, KY (US); Michael Anthony Marra, III, Lexington, KY (US); John Thomas Writt, Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 0 days.

(21) Appl. No.: 09/907,773

(22) Filed: Jul. 18, 2001

(65) Prior Publication Data

US 2003/0122886 A1 Jul. 3, 2003

(51) Int. Cl.[7] ..... B41J 29/393; B41J 29/38
(52) U.S. Cl. ..... 347/19; 347/14
(58) Field of Search ..... 347/19, 14, 23, 347/37, 40, 12, 10, 11, 51, 8, 6

(56) References Cited

U.S. PATENT DOCUMENTS

| | | | | |
|---|---|---|---|---|
| 3,810,194 A | | 5/1974 | Tokunaga et al. | 346/75 |
| 3,852,768 A | | 12/1974 | Carmichael et al. | |
| 3,886,564 A | | 5/1975 | Naylor, III et al. | |
| 3,977,010 A | | 8/1976 | Erickson et al. | |
| 4,067,019 A | | 1/1978 | Fleischer et al. | |
| 4,092,591 A | | 5/1978 | Lozowski | 324/110 |
| 4,121,223 A | | 10/1978 | Omori et al. | |
| 4,136,345 A | | 1/1979 | Neville et al. | |
| 4,217,594 A | | 8/1980 | Meece et al. | |
| 4,286,273 A | | 8/1981 | Horike | |
| 4,333,083 A | | 6/1982 | Aldridge | 346/1.1 |
| 4,509,057 A | | 4/1985 | Sohl et al. | 347/19 |
| 4,737,803 A | | 4/1988 | Fujimura et al. | 346/140 |
| 4,751,517 A | | 6/1988 | Crean et al. | |
| 4,768,045 A | | 8/1988 | Koto | 347/19 |
| 4,797,688 A | | 1/1989 | Furukawa | |
| 4,990,932 A | | 2/1991 | Houston | |
| 5,036,340 A | | 7/1991 | Osborne | 347/19 |
| 5,160,939 A | | 11/1992 | Bajeux et al. | |
| 5,164,747 A | | 11/1992 | Osada et al. | |
| 5,721,574 A | | 2/1998 | Kubby | 347/7 |
| 5,739,832 A | | 4/1998 | Heinzl et al. | 347/68 |
| 5,771,051 A | | 6/1998 | Guenther et al. | 347/19 |
| 5,796,414 A | | 8/1998 | Sievert et al. | 347/19 |
| 5,815,175 A | | 9/1998 | Seikel | 347/23 |
| 5,859,653 A | | 1/1999 | Aoki et al. | |
| 5,929,875 A | | 7/1999 | Su et al. | 347/19 |
| 5,936,645 A | | 8/1999 | Niikura et al. | 347/14 |
| 5,984,455 A | | 11/1999 | Anderson | 347/47 |
| 5,992,984 A | | 11/1999 | Imanaka et al. | 347/65 |
| 5,995,067 A | | 11/1999 | Terasawa et al. | 345/23 |
| 6,007,173 A | | 12/1999 | DeLouise et al. | 347/7 |
| 6,039,429 A | | 3/2000 | Balousek | 347/19 |
| 6,062,668 A | | 5/2000 | Cruz-Uribe | 347/19 |
| 6,076,909 A | | 6/2000 | Saeki et al. | |
| 6,137,503 A | * | 10/2000 | Hashimoto et al. | 347/19 |
| 6,250,735 B1 | | 6/2001 | Kaneko et al. | 347/19 |
| 6,299,275 B1 | | 10/2001 | Elgee | 347/19 |
| 6,378,978 B1 | | 4/2002 | Chang et al. | 347/19 |
| 6,398,334 B2 | | 6/2002 | Dunand | 347/14 |
| 6,454,400 B1 | * | 9/2002 | Morita et al. | 347/86 |

* cited by examiner

*Primary Examiner*—Stephen D. Meier
*Assistant Examiner*—Charles W. Stewart, Jr.
(74) *Attorney, Agent, or Firm*—Taylor & Aust, P.C.

(57) ABSTRACT

A method of calculating at least a component of ink drop velocity in an ink jet printer includes jetting at least one first ink drop from a printhead firing plane. It is detected when the first ink drop is a first predetermined distance away from a reference plane. A first time period between the jetting and the detecting of the first ink drop is measured. At least one second ink drop is jetted from the printhead firing plane. It is detected when the second ink drop is a second predetermined distance away from the reference plane. A second time period between the jetting and the detecting of the second ink drop is measured. A difference between the first predetermined distance and the second predetermined distance is divided by a difference between the first time period and the second time period.

43 Claims, 7 Drawing Sheets

INKJET PRINTER AND METHOD FOR USE THEREOF

BACKGROUND OF THE INVENTION

1. Field of the Invention

The present invention relates to ink jet printers, and, more particularly, to a method and apparatus for measuring the printhead gap and drop velocity in an ink jet printer.

2. Description of the Related Art

One of the major factors that contribute to the quality of printing in an ink jet printer is the printhead gap, which is defined as the distance between the printhead nozzle plate (printhead firing plane) and the top surface of the print media (media surface plane). The printhead gap plays a large role in the issues of alignment and drop pattern on the media. From printer to printer, the printhead gap can be quite different due to multiple tolerance issues in the mechanical structure of the printer.

What is needed in the art is a device for measuring the printhead gap and drop velocity.

SUMMARY OF THE INVENTION

The present invention provides a very inexpensive apparatus that can be installed in every printer to effectively measure the printhead gap and the drop velocity.

The invention comprises, in one form thereof, a method of calculating at least a component of ink drop velocity in an ink jet printer. At least one first ink drop is jetted from a printhead firing plane. It is detected when the first ink drop is a first predetermined distance away from a reference plane. The reference plane can be the media surface plane or the platen on which the media is supported when in the print zone. A first time period between the jetting and the detecting of the first ink drop is measured. At least one second ink drop is jetted from the printhead firing plane. It is detected when the second ink drop is a second predetermined distance away from the reference plane. A second time period between the jetting and the detecting of the second ink drop is measured. A difference between the first predetermined distance and the second predetermined distance is divided by a difference between the first time period and the second time period.

The invention comprises, in another form thereof, an ink jet printer including a reference plane near and parallel to a media surface plane. A first sensor detects a presence of a first ink drop at a first predetermined distance from a reference plane. The reference plane can be the media surface plane or the platen on which the media is supported when in the print zone. A second sensor detects a presence of a second ink drop at a second predetermined distance from the reference plane. A processing device calculates a velocity of the first ink drop and the second ink drop based on the first predetermined distance, the second predetermined distance, a first time period between the printhead firing the first ink drop and the first sensor sensing the first ink drop, and a second time period between the printhead firing the second ink drop and the second sensor sensing the second ink drop.

The invention comprises, in yet another form thereof, a method of determining a length of a printhead gap between a printhead and a print media surface plane in an ink jet printer. A first ink drop is jetted from a printhead firing plane. It is detected when the first ink drop is at a first location a first predetermined distance away from a reference plane. A first time period between the jetting and the detecting of the first ink drop is measured. A second ink drop is jetted from the printhead firing plane. It is detected when the second ink drop is at a second location a second predetermined distance away from the reference plane. A second time period between the jetting and the detecting of the second ink drop is measured. An ink drop velocity is calculated by dividing a difference between the first predetermined distance and the second predetermined distance by a difference between the first time period and the second time period. A detecting distance is determined by multiplying the ink drop velocity by the first time period. The length of the printhead gap is ascertained by subtracting a distance between the media surface plane and the first location from the detecting distance, or by adding the distance between the media surface plane and the first location to the detecting distance.

The invention comprises, in a further form thereof, a method of determining an ink drop speed in a jetting direction in an ink jet printer. A printhead is moved in a scanning direction. A first ink drop is jetted in the jetting direction during the moving step. When the first ink drop is at a first location is detected. A first distance traveled by the printhead between the jetting and the detecting of the first ink drop is measured. The printhead is moved in the scanning direction or a second direction substantially opposite to the scanning direction. A second ink drop is jetted in the jetting direction during the second moving step. It is detected when the second ink drop is at a second location. A second distance traveled by the printhead between the jetting and the detecting of the second ink drop is measured. The ink drop speed is calculated dependent upon the first distance, the second distance, and a distance between the first location and the second location in the jetting direction.

An advantage of the present invention is that the printhead gap and drop velocity can be easily and inexpensively measured.

Another advantage is that ink type can be determined.

Yet another advantage is that missing or malfunctioning ink jet nozzles can be detected.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

Corresponding reference characters indicate corresponding parts throughout the several views. The exemplifications set out herein illustrate one preferred embodiment of the invention, in one form, and such exemplifications are not to be construed as limiting the scope of the invention in any manner.

DETAILED DESCRIPTION OF THE INVENTION

Figure 1:
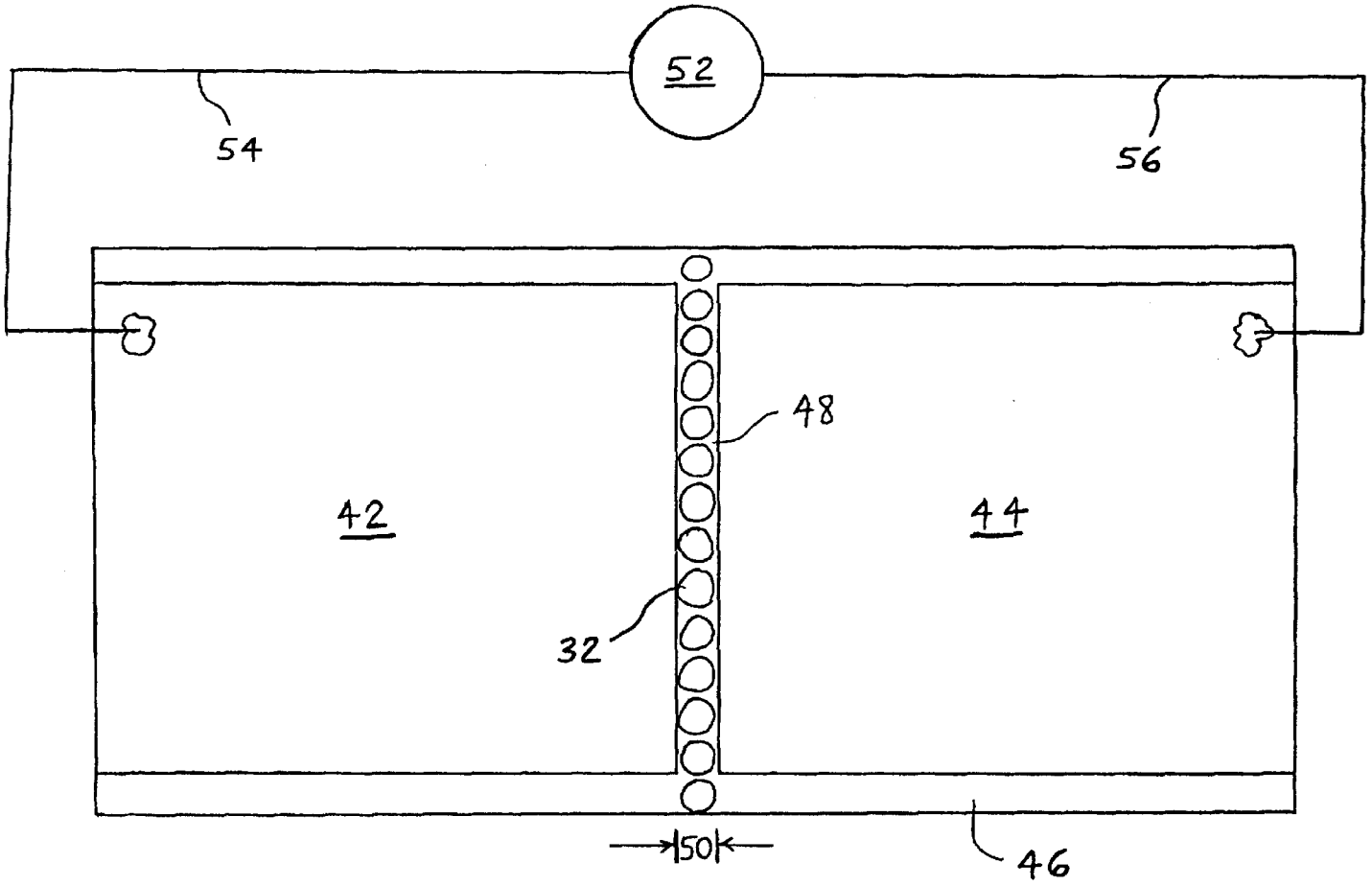
FIG. 1 is an overhead schematic view of one embodiment of a slotted sensor which can be used in conjunction with one embodiment of the method of the present invention.

Referring now to the drawings and particularly to FIG. 1, there is shown one embodiment of a slotted sensor 40 of the present invention, including two copper terminals 42, 44 on a mylar substrate 46. Terminals 42, 44 are separated by a gap 48 having a width 50 of approximately between 1/1200-inch and 1/600-inch, which is approximately the width of an ink drop 32. Gap 48 can be formed by laser cutting. An ohmmeter 52 has leads 54, 56 connected to terminals 42, 44, respectively, to measure the resistance therebetween. When no ink drops 32 are between terminals 42 and 44, the resistance between terminals 42 and 44 is many hundreds of megohms. If a single column of ink drops 32 is printed from a printhead into gap 48 on an outside surface of sensor 40, as illustrated in FIG. 1, the resistance between terminals 42, 44 drops into the range of approximately between 0.5 and 3 megohms. Printing this column of ink drops 32 even one print element (pel) off-center of gap 48 leaves the resistance between terminals 42, 44 at several hundred megohms. One pel is defined herein as the width of one ink drop. Once printed in gap 48, the ink evaporates within a few seconds, and the resistance returns to several hundred megohms. Thus, slotted sensor 40 is re-usable, i.e., it may be used for several repetitions. Instead of ohmmeter 52, leads 54, 56 can be connected to a simple circuit that is able to give a digital response when gap 48 has been printed upon.

Figure 2:
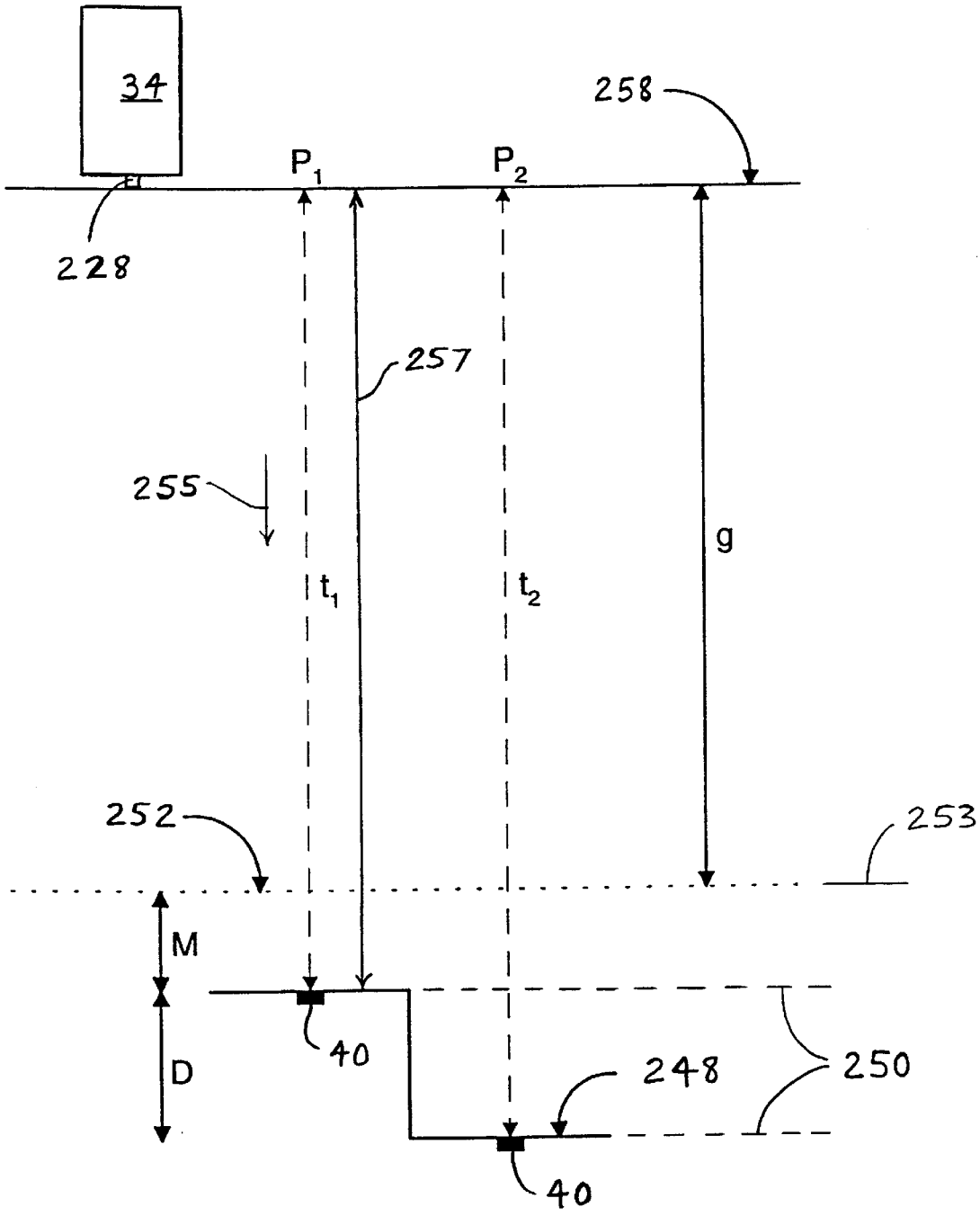
FIG. 2 is a schematic side view of the path of an ink drop from a printhead to two sensors like that of FIG. 1.

A sensor assembly 248 (FIG. 2) of the present invention includes two sensors 40 mounted at different heights. The sensing planes 250 (in the plane of FIG. 1) of sensors 40 are parallel and separated by a distance D. Sensor assembly 248 is mounted in the printer in the print zone at a distance M from a reference media surface plane 252 of an average media. Media surface plane 252 can be a plane in which a platen, schematically indicated at 253, supports a media in a print zone.

In one embodiment of a method of measuring a printhead gap g and a drop velocity, a printhead 34 is positioned to one of the P locations, say $P_1$ for this example. Printhead 34 has a plurality of nozzles 228, only one of which is visible in FIG. 2. Printhead 34, after reaching location $P_1$, fires a single column of ink drops in jetting direction 255, which land on the upper sensor 40. During this event, a fast timer 254 (FIG. 3) in printer electronics 256, which may be an application specific integrated circuit (ASIC), measures the time between the firing of printhead 34 and sensor 40 sensing the column of ink, i.e., the time in which the ink drop traverses a detecting distance 257. This time is designated as $t_1$. Printhead 34 then moves along its scan path to the other position ($P_2$ in this example) and repeats the above action, firing on the lower sensor 40 and recording a time $t_2$ between the firing of printhead 34 and sensor 40 sensing the column of ink. A time differential ($t_d$) is then calculated using the equation $t_d=t_2-t_1$. Because the distance D between the two sensors 40 in jetting direction 255 is known, a velocity $v_d$ of the drop can then be calculated using the equation $v_d=D/t_d$. With the velocity $v_d$ of the drop now known, it is easy to compute the printhead gap g between a printhead firing plane 258 and the parallel media surface plane 252. Taking into account the distance M between the upper sensor 40 and media surface plane 252, the printhead gap g is computed as $g=(v_d*t_1)-M$. Detecting distance 257 can be expressed as $(v_d*t_1)$.

Figure 3:
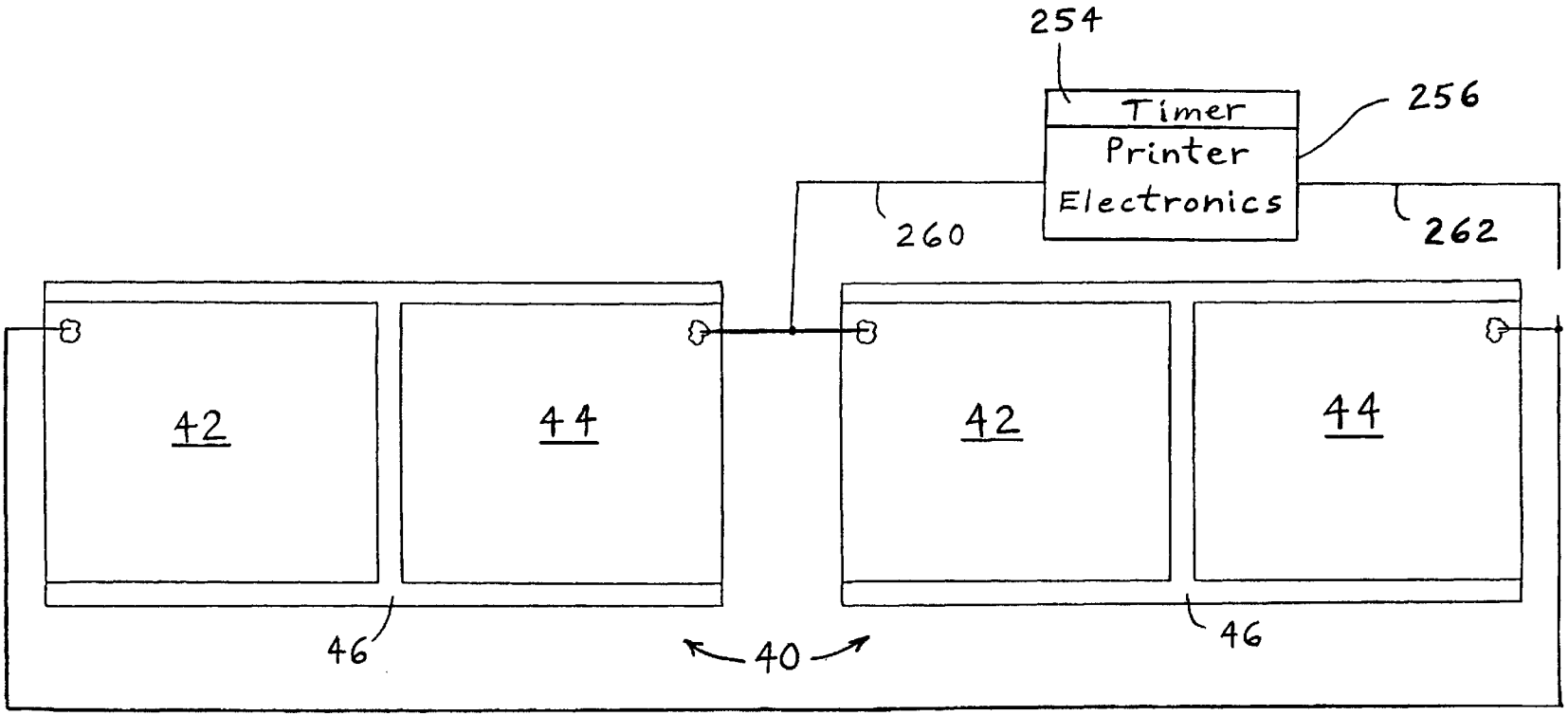
FIG. 3 is an overhead schematic view of the sensors of FIG. 2 connected to printer electronics.

Additional cost savings are achieved by connecting the terminals 42, 44 of the two sensors 40 as shown in FIG. 3 so that instead of four leads coming back to electronics 256, only two leads 260, 262 are present.

The method of the present invention has been illustrated herein as using slotted sensors 40. However, it is to be understood that any other type of sensor that senses ink drops can also be used in the method of the present invention.

The method of the present invention has been illustrated herein with printhead 34 being stationary at locations $P_1$ and $P_2$. However, it is to be understood that it is also possible for printhead 34 to be in motion when it fires the ink that impinges upon sensors 40. The calculation of the length of the printhead gap g would remain substantially the same, however $v_d$ would represent only a component of the velocity of the drop, i.e., the component in the direction perpendicular to media surface plane 252.

Figure 4:
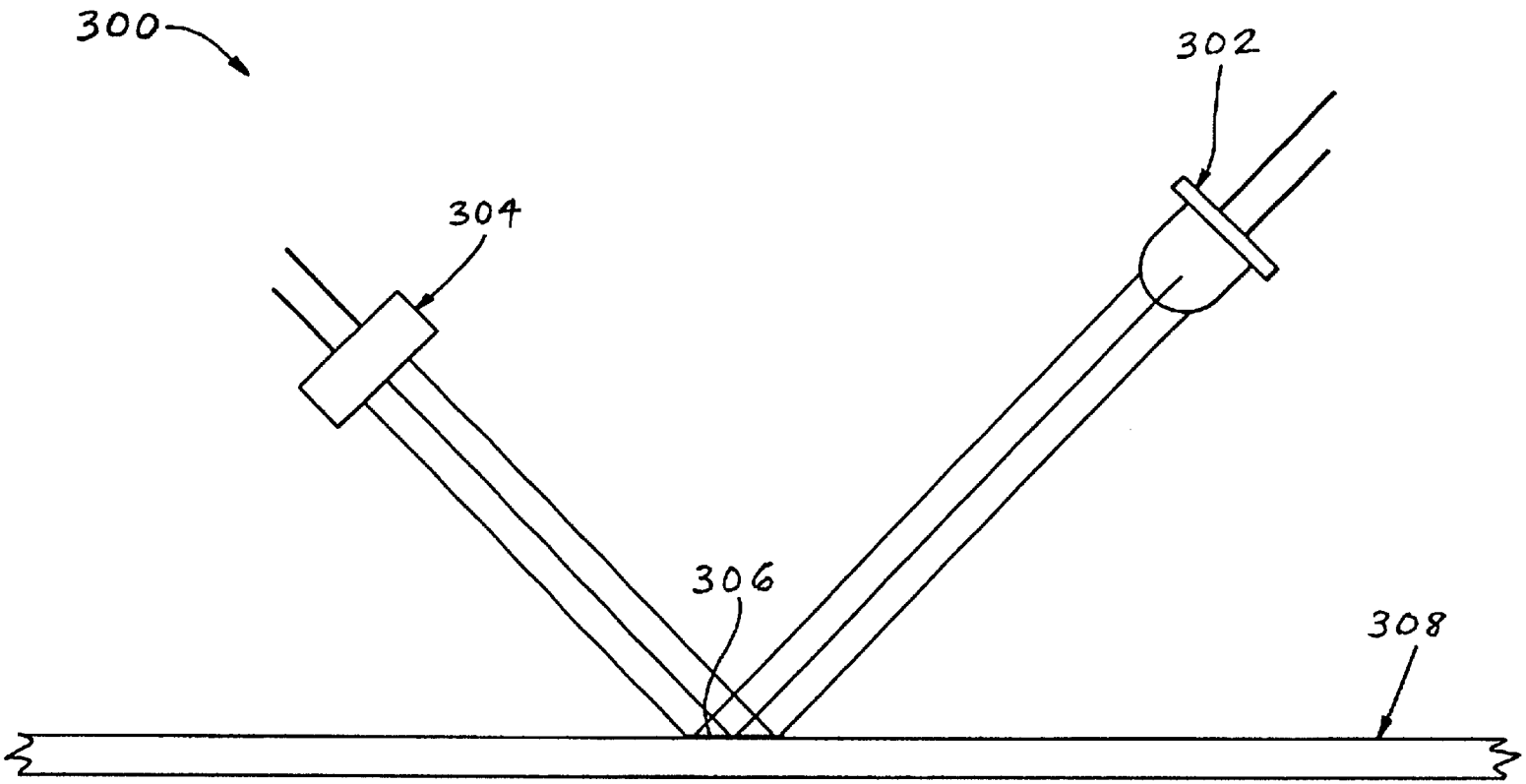
FIG. 4 is a side, schematic side view of a sensor arrangement which can be used in conjunction with another embodiment of the method of the present invention.

In another embodiment (FIG. 4), an optical device 300 includes a light source 302 and a light detector 304. Light source 302 illuminates an ink test patch 306 on a test surface 308. Test surface 308 can be, for example, a sheet of paper or a surface provided as part of the printer and outside of the normal printing area. The light reflecting off of ink patch 306 is sensed by light detector 304. Different ink types absorb different levels of light from source 302, which affects the intensity of light projected onto light detector 304, thus varying an output signal of light detector 304 depending on how much light was absorbed versus transmitted to light detector 304. For example, a pigmented black ink absorbs/blocks more light than a color dye-based ink. Therefore, a higher intensity of light is projected to light detector 304 in the case of the dye-based ink. Thus, the ink type can be determined based upon the intensity of the light received by light detector 304.

For a light source emitting light at a specific frequency (such as a light emitting diode having a wavelength of 632 nm), different color inks absorb different amounts of light depending on how close their spectrum lies in relation to the spectrum associated with the light source. Multiple light sources can also be used, and the light detectors can be calibrated for each source such that the appropriate signal ranges are known for each ink type.

Figure 5:
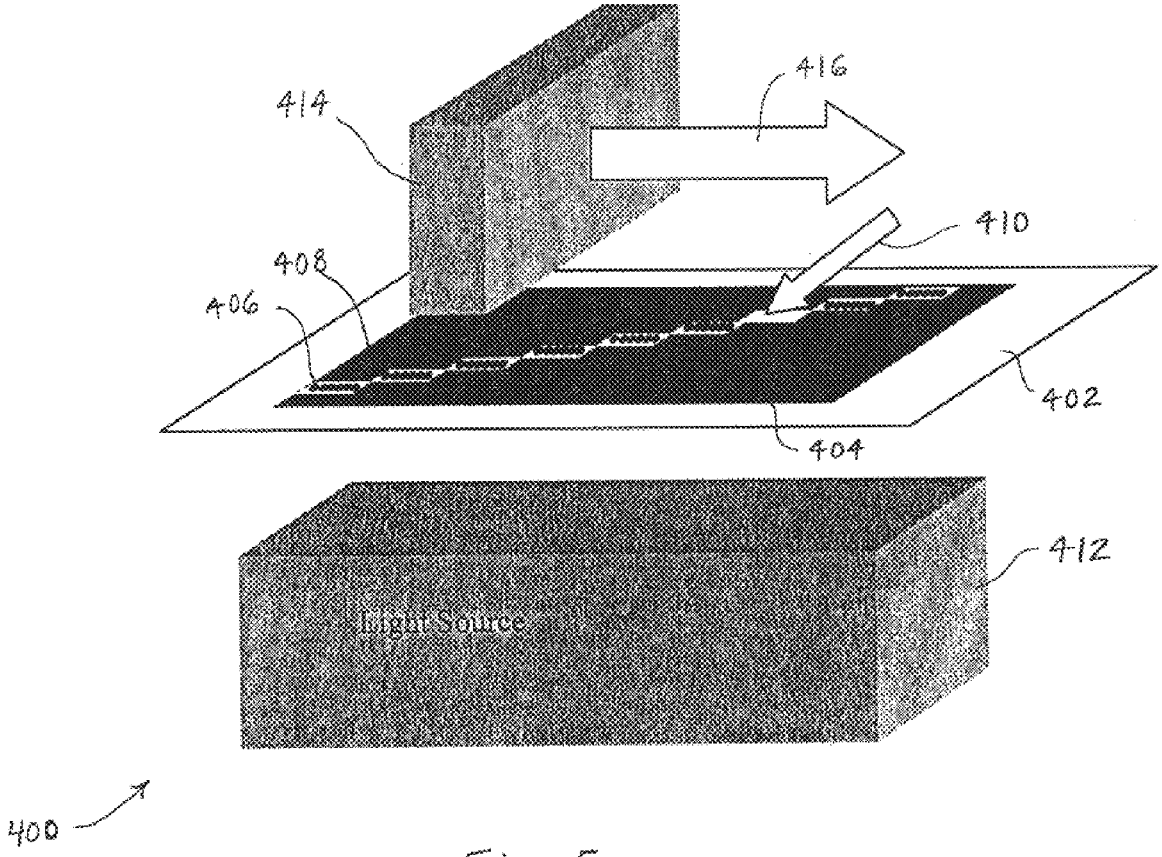
FIG. 5 is a perspective view of an optical device and a mask which can be used in conjunction with yet another embodiment of the method of the present invention.

In yet another embodiment (FIG. 5), an optical device 400 uses a test surface 402 with a mask 404 to detect missing nozzles, i.e., malfunctioning nozzles, in an ink jet printhead such as printhead 34. Surface 402 can be a piece of substantially transparent mylar film which is exposed to a laser in order to darken the sections forming mask 404. Surface 402 is printed upon in a manner so that, as the printhead scans across surface 402, individual nozzles, such as nozzle 228, fill respective transparent areas or "gaps" in mask 404. For example, a first nozzle can fill gap 406, a second nozzle can fill gap 408, and so on. In the embodiment of FIG. 5, a seventh nozzle is missing and fails to fill in the gap indicated by arrow 410. Optical device 400, which can be attached to a frame of the printer, includes a light source 412 and a scanning light detector 414, which detects the presence or absence of ink on surface 402. As detector 414 scans across surface 402 in the direction indicated by arrow 416, detector 414 checks each gap individually to detect whether light is being emitted through each individual gap. Detector 414 can follow the same path as taken by the printhead in filling the gaps. For example, detector 414 can be mounted to the printhead carrier. When detector 414 is positioned above gap 410, detector 414 detects light being emitted through gap 410. Printer electronics, such as printer electronics 256, determines that the seventh nozzle is missing based upon the position of detector 414 in direction 416, i.e., above gap 410, when the light is detected.

The embodiment of FIG. 5 shows light detector 414 scanning across surface 402. However, it is to be understood that it is also possible for a light source to scan across surface 402 instead of, or in addition to, light detector 414.

Figure 6B:
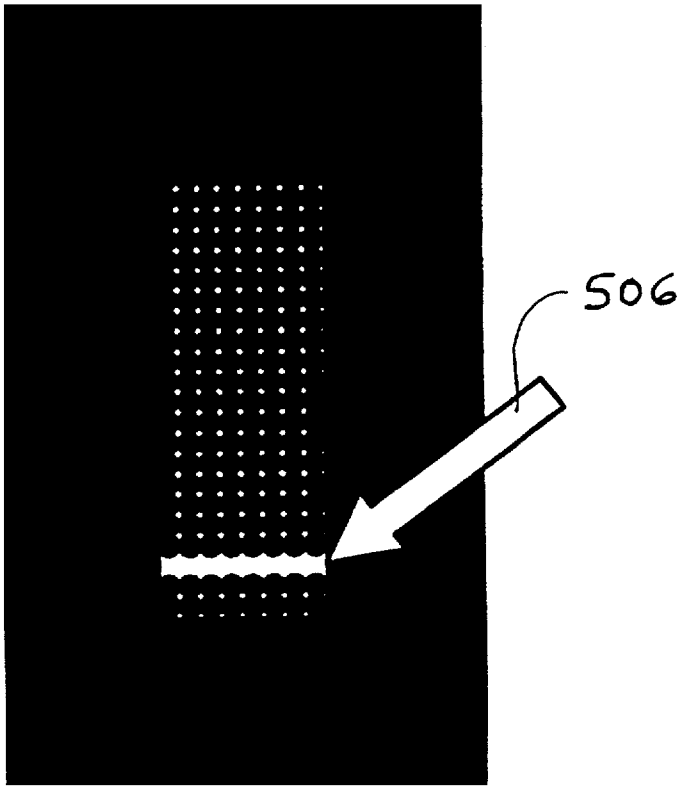
FIG. 6B is another top view of the mask of FIG. 5*a;*.
Figure 6A:
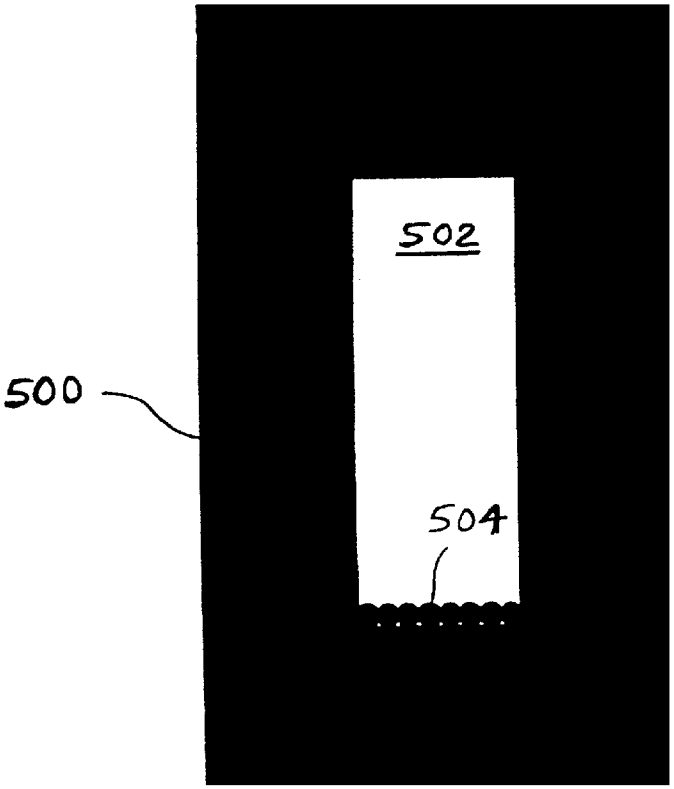
FIG. 6A is a top view of another embodiment of a mask which can be used in conjunction with a further embodiment of the method of the present invention.

In a further embodiment, a mask 500 (FIG. 6A) on a test surface includes a rectangular transparent region 502 in which each of a plurality of nozzles sequentially prints a respective row of ink dots, such as row of ink dots 504 printed by a first nozzle. After each row of dots is iteratively printed, a light source emits light through transparent region 502, and a light detector, which is on an opposite side of mask 500 from the light source, detects the level of light emitted through transparent region 502. Each row of dots incrementally reduces the amount of light that is emitted through transparent region 502. If the attempted printing of a row of dots does not result in a decrease in the level of detected light, then the printer electronics determines that the nozzle used in attempting to print the row of dots is missing, i.e., is not firing correctly. This process is repeated for all nozzles, measuring the change in the output of the light sensor after each step. FIG. 6B illustrates a case in which a third nozzle is missing, resulting in an open area, indicated by arrow 506, where printing of the corresponding third row of ink dots was attempted.

Figure 7:
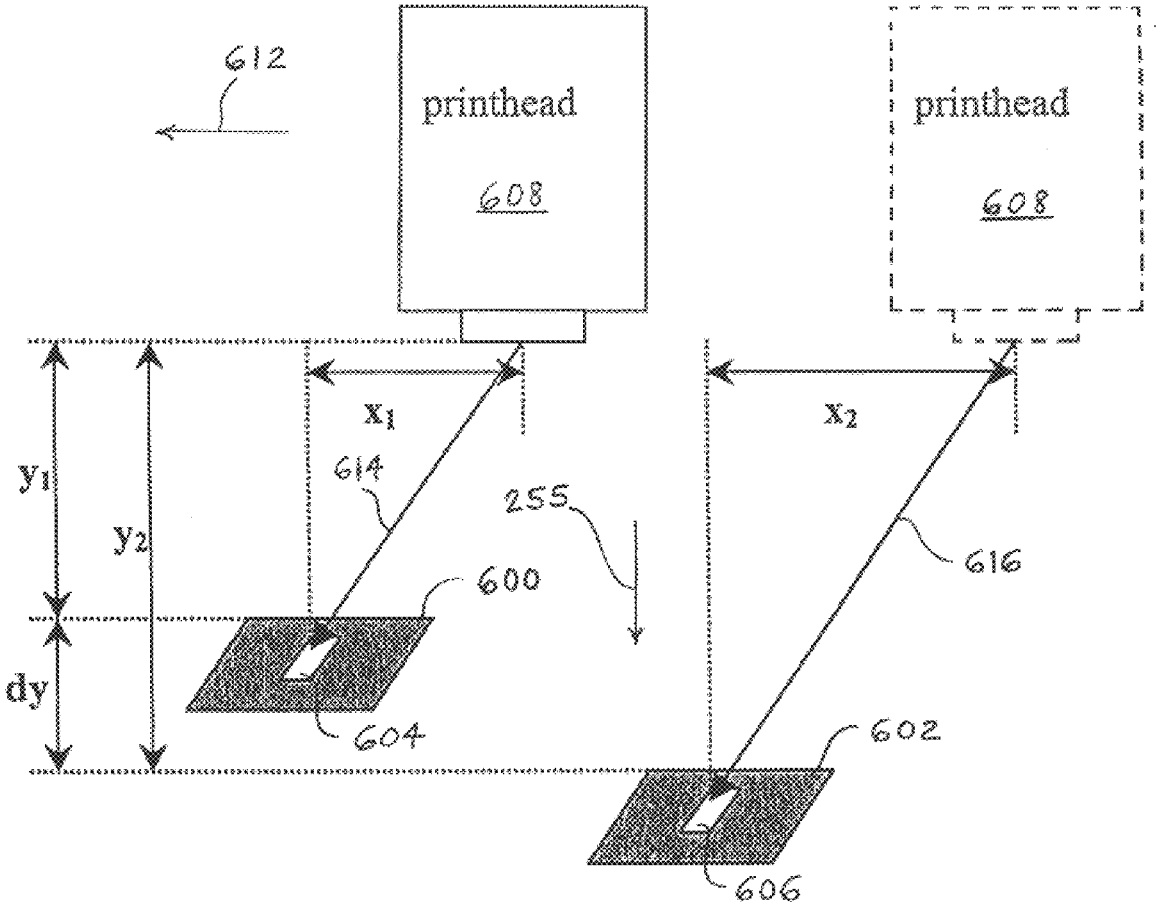
FIG. 7 is a schematic perspective view of the path of an ink drop from a printhead to another embodiment of sensors which can be used in conjunction with another embodiment of the method of the present invention.

In a still further embodiment, masks 600 and 602 (FIG. 7) disposed on respective test surfaces are similar to mask 500, but are used to measure ink drop velocity and printhead gap instead of determining whether nozzles are missing. In this embodiment too, at least one unshown light source emits light through transparent areas 604, 606, which light is detected by at least one unshown light detector on an opposite side of masks 600, 602. It is possible for the light source and the light detector to be disposed in many locations. For example, the light source can be disposed below masks 600 and 602 with the light detector being disposed on the carrier of printhead 608.

In order to measure ink drop velocity in jetting direction 255 and printhead gap, it is assumed that the gaps $y_1$ and $y_2$ between printhead 608 and masks 600, 602 are unknown, but the difference dy between gaps $y_1$ and $y_2$, i.e., the gap between masks 600, 602 as measured in the jetting direction 255, is known. While the carrier of printhead 608 is traveling at velocity $V_{carrier}$ in scanning direction 612, printhead 608 jets ink onto the substrate of mask 600 with a printhead gap of $y_1$. The trajectory of the ink is indicated by arrow 614. The printer electronics measures a time period $t_1$ between the ink being jetted from printhead 608 and the ink being detected on mask 600 by the optical device. The carrier then returns printhead 608 to the right in FIG. 7, i.e., in the direction opposite to direction 612, and then starts to move again in direction 612. While the carrier of printhead 608 is again traveling at velocity $V_{carrier}$ in direction 612, and when printhead 608 is at the position shown in dashed lines in FIG. 7, printhead 608 jets ink onto the substrate of mask 602 with a printhead gap of $y_2=dy+y_1$. The trajectory of the ink is indicated by arrow 616. The printer electronics measures a time period $t_2$ between the ink being jetted from printhead 608 and the ink being detected on mask 602 by the optical device. Then the following set of equations can be solved for drop velocity $V_{drop}$ and printhead gap $y_1$:

$$t_1=y_1/V_{drop}$$

$$t_2=(y_1+dy)/V_{drop},$$

which yields:

$$V_{drop}=dy/(t_2-t_1),$$

and $$y_1=t_1(dy)/(t_2-t_1).$$

In another embodiment, the distance $x_1$ the ink drop travels in direction of carrier motion 612 is measured instead of the flight time of the ink drop. While the carrier of printhead 608 is traveling at velocity $V_{carrier}$ in direction 612, printhead 608 jets ink onto the substrate of mask 600 with a printhead gap of $y_1$. When the ink is detected by the optical device, the printer electronics measures and records a distance $x_1$ traveled by the ink drop in direction 612 based upon the carrier velocity $V_{carrier}$ and the time period $t_1$ between the ink being jetted from printhead 608 and the ink being detected on mask 600 by the optical device. Alternatively, the distance $x_1$ can be measured based upon the position of the printhead when it emits the ink and the position of the printhead when the ink is detected by the optical device. While the carrier of printhead 608 is again traveling at velocity $V_{carrier}$ in direction 612, printhead 608 jets ink onto the substrate of mask 602 with a printhead gap of $y_2=y_1+dy$. When the ink is detected by the optical device, the printer electronics measures and records a distance $x_2$ traveled by the ink drop in direction 612. Then the following set of equations can be solved for drop velocity $V_{drop}$ and printhead gap $y_1$:

$$x_1=(V_{carrier}/V_{drop})y_1$$

$$x_2=(V_{carrier}/V_{drop})(y_1+dy)$$

which yields:

$$V_{drop}=V_{carrier}(dy)/(x_2-x_1),$$

and $$y_1=x_1(dy)/(x_2-x_1).$$

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. An ink jet printer, comprising:

a reference plane near and parallel to a media surface plane;

a first sensor configured to detect a presence of a first ink drop at a first predetermined distance from the reference plane;

a second sensor configured to detect a presence of a second ink drop at a second predetermined distance from the reference plane; and a processing device configured to calculate a velocity of the first ink drop and the second ink drop based on:
the first predetermined distance;
the second predetermined distance;
a first time period between a printhead firing the first ink drop and said first sensor sensing the first ink drop; and
a second time period between said printhead firing the second ink drop and said second sensor sensing the second ink drop.

2. The printer of claim 1, wherein said printhead and said first sensor are disposed on opposite sides of a print media surface plane.

3. The printer of claim 1, wherein said printhead and said second sensor are disposed on opposite sides of a print media surface plane.

4. The printer of claim 1, wherein said reference plane comprises a media surface plane of an average media.

5. The printer of claim 1, wherein said reference plane comprises a plane in which a platen supports a media in a print zone.

6. An ink jet printer, comprising:
a reference plane near and parallel to a media surface plane;
a first sensor configured to detect a presence of a first ink drop at a first predetermined distance from the reference plane;
a second sensor configured to detect a presence of a second ink drop at a second predetermined distance from the reference plane; and
a processing device configured to calculate a velocity of the first ink drop and the second ink drop based on:
the first predetermined distance;
the second predetermined distance;
a first time period between a printhead firing the first ink drop and said first sensor sensing the first ink drop; and
second time period between said printhead firing the second ink drop and said second sensor sensing the second ink drop,
wherein at least one of said first sensor and said second sensor has an outside surface, said at least one of said first sensor and said second sensor being configured to detect a presence of at least one of the first ink drop and the second ink drop on said outside surface.

7. The printer of claim 6, wherein said first sensor is separated from the reference plane by the first predetermined distance.

8. The printer of claim 7, wherein said second sensor is separated from the reference plane by the second predetermined distance.

9. An ink jet printer, comprising:
a reference plane near and parallel to a media surface plane;
a first sensor configured to detect a presence of a first ink drop at a first predetermined distance from the reference plane;
a second sensor configured to detect a presence of a second ink drop at a second predetermined distance from the reference plane; and
a processing device configured to calculate a velocity of the first ink drop and the second ink drop based on:
the first predetermined distance;
the second predetermined distance;
a first time period between a printhead firing the first ink drop and said first sensor sensing the first ink drop; and
a second time period between said printhead firing the second ink drop and said second sensor sensing the second ink drop,
wherein said first sensor includes two first terminals defining a first gap therebetween, said first sensor being configured to detect a presence of ink in said first gap as a reduction in a first electrical resistance between said first terminals, said second sensor including two second terminals defining a second gap therebetween, said second sensor being configured to detect a presence of ink in said second gap as a reduction in a second electrical resistance between said second terminals.

10. The printer of claim 9, wherein one of said first terminals is electrically connected to one of said second terminals, an other of said first terminals being electrically connected to an other of said second terminals.

11. The printer of claim 9, wherein said first sensor includes a first substrate configured to support the ink between said first terminals, said second sensor including a second substrate configured to support the ink between said second terminals.

12. A method of calculating at least a component of ink drop velocity in an ink jet printer, said method comprising the steps of:
jetting at least one first ink drop from a printhead firing plane;
detecting when the first ink drop is a first predetermined distance away from a reference plane;
measuring a first time period between said jetting and said detecting of the first ink drop;
jetting at least one second ink drop from the printhead firing plane;
detecting when the second ink drop is a second predetermined distance away from the reference plane;
measuring a second time period between said jetting and said detecting of the second ink drop; and
dividing a difference between the first predetermined distance and the second predetermined distance by a difference between the first time period and the second time period.

13. The method of claim 12, comprising the further step of providing a first ink drop sensor at a first location, the first location being separated from the reference plane by the first predetermined distance, said step of jetting the at least one first ink drop comprising jetting the at least one first ink drop from the printhead firing plane onto said first ink drop sensor.

14. The method of claim 13, comprising the further step of providing a second ink drop sensor at a second location, the second location being separated from the reference plane by the second predetermined distance, said step of jetting the at least one second ink drop comprising jetting the at least one second ink drop from the printhead firing plane onto said second ink drop sensor.

15. The method of claim 12, comprising the further step of providing a processing device for performing said measuring and dividing steps.

16. A method of calculating at least a component of ink drop velocity in an ink jet printer, said method comprising the steps of:
jetting at least one first ink drop from a printhead firing plane;
detecting when the first ink drop is a first predetermined distance away from a reference plane;
measuring a first time period between said jetting and said detecting of the first ink drop;

jetting at least one second ink drop from the printhead firing plane;

detecting when the second ink drop is a second predetermined distance away from the reference plane;

measuring a second time period between said jetting and said detecting of the second ink drop;

dividing a difference between the first predetermined distance and the second predetermined distance by a difference between the first time period and the second time period;

providing a first ink drop sensor at a first location, the first location being separated from the reference plane by the first predetermined distance, said step of jetting the at least one first ink drop comprising jetting the at least one first ink drop from the printhead firing plane onto said first ink drop sensor; and providing a second ink drop sensor at a second location, the second location being separated from the reference plane by the second predetermined distance, said step of jetting the at least one second ink drop comprising jetting the at least one second ink drop from the printhead firing plane onto said second ink drop sensor, wherein said first sensor includes two first terminals defining a first gap therebetween, said step of detecting the first ink drop including detecting a presence of ink in said first gap as a reduction in a first electrical resistance between said first terminals, said second sensor including two second terminals defining a second gap therebetween, said step of detecting the second ink drop including detecting a presence of ink in said second gap as a reduction in a second electrical resistance between said second terminals.

17. The method of claim 16, wherein said step of jetting the at least one first ink drop includes jetting a plurality of first ink drops, the plurality of first ink drops including a column of first ink drops jetted into said first gap of said first sensor, said step of jetting the at least one second ink drop including jetting a plurality of second ink drops, the plurality of second ink drops including a column of second ink drops jetted into said second gap of said second sensor.

18. A method of determining a length of a printhead gap between a printhead and a print media surface plane in an ink jet printer, said method comprising the steps of:

jetting a first ink drop from a printhead firing plane;

detecting when the first ink drop is at a first location a first predetermined distance away from a reference plane;

measuring a first time period between said jetting and said detecting of the first ink drop;

jetting a second ink drop from the printhead firing plane;

detecting when the second ink drop is at a second location a second predetermined distance away from the reference plane;

measuring a second time period between said jetting and said detecting of the second ink drop;

calculating an ink drop velocity by dividing a difference between the first predetermined distance and the second predetermined distance by a difference between the first time period and the second time period;

determining a detecting distance by multiplying the ink drop velocity by the first time period; and ascertaining the length of the printhead gap by one of:

subtracting a distance between the media surface plane and the first location from the detecting distance; and adding the distance between the media surface plane and the first location to the detecting distance.

19. The method of claim 18, comprising the further step of providing a first ink drop sensor at the first location, the first location being separated from the reference plane by the first predetermined distance, said step of jetting the first ink drop comprising jetting the first ink drop from the printhead firing plane onto said first ink drop sensor.

20. The method of claim 19, wherein said printhead and said first ink drop sensor are disposed on opposite sides of the print media surface plane, said step of one of subtracting and adding comprising subtracting a distance between the media surface plane and the first location from the detecting distance.

21. The method of claim 18, wherein the media surface plane is substantially parallel to the printhead firing plane.

22. The method of claim 18, wherein the printhead firing plane is defined by a scan path of said printhead.

23. The method of claim 18, wherein the reference plane is substantially parallel to the printhead firing plane.

24. An ink jet printer, comprising:

a first sensor configured to detect a presence of a first ink drop at a first location;

a second sensor configured to detect a presence of a second ink drop at a second location; and a processing device configured to calculate a speed of the first ink drop and the second ink drop in a jetting direction based on:

a first time period between a printhead firing the first ink drop and said first sensor sensing the first ink drop;

a second time period between said printhead firing the second ink drop and said second sensor sensing the second ink drop; and a distance between the first location and the second location in the jetting direction.

25. A method of determining an ink drop speed in a jetting direction in an ink jet printer, said method comprising the steps of:

jetting a first ink drop in the jetting direction;

detecting when the first ink drop is at a first location;

measuring a first time period between said jetting and said detecting of the first ink drop;

jetting a second ink drop in the jetting direction;

detecting when the second ink drop is at a second location;

measuring a second time period between said jetting and said detecting of the second ink drop; and calculating the ink drop speed dependent upon:

the first time period;

the second time period; and a distance between the first location and the second location in the jetting direction.

26. The method of claim 25, wherein said calculating step includes dividing a distance between the first location and the second location in the jetting direction by a difference between the first time period and the second time period.

27. A method of determining a length of a printhead gap between a printhead and a print media surface plane in an ink jet printer, said method comprising the steps of:

jetting a first ink drop from a printhead firing plane in a jetting direction;

detecting when the first ink drop is at a first location;

measuring a first time period between said jetting and said detecting of the first ink drop;

jetting a second ink drop from the printhead firing plane in the jetting direction;

detecting when the second ink drop is at a second location;

measuring a second time period between said jetting and said detecting of the second ink drop;

calculating an ink drop speed in the jetting direction by dividing a distance between the first location and the second location in the jetting direction by a difference between the first time period and the second time period;

determining a detecting distance by multiplying the ink drop speed by the first time period; and ascertaining the length of the printhead gap by one of:

subtracting a distance between the media surface plane and the first location from the detecting distance; and adding the distance between the media surface plane and the first location to the detecting distance.

28. A method of determining a printhead gap between a printhead and a first location in a jetting direction in an ink jet printer, said method comprising the steps of:

jetting a first ink drop from the printhead in the jetting direction;

detecting when the first ink drop is at the first location;

measuring a first time period between said jetting and said detecting of the first ink drop;

jetting a second ink drop from the printhead in the jetting direction;

detecting when the second ink drop is at a second location;

measuring a second time period between said jetting and said detecting of the second ink drop; and calculating the printhead gap dependent upon:

the first time period;

the second time period; and a distance between the first location and the second location in the jetting direction.

29. A method of determining an ink drop speed in a jetting direction in an ink jet printer, said method comprising the steps of:

moving a printhead in a scanning direction;

jetting a first ink drop in the jetting direction during said moving step;

detecting when the first ink drop is at a first location;

measuring a first distance traveled by the printhead between said jetting and said detecting of the first ink drop;

moving the printhead in one of the scanning direction and a second direction substantially opposite to the scanning direction;

jetting a second ink drop in the jetting direction during said second moving step;

detecting when the second ink drop is at a second location;

measuring a second distance traveled by the printhead between said jetting and said detecting of the second ink drop; and calculating the ink drop speed dependent upon:

the first distance;

the second distance; and a distance between the first location and the second location in the jetting direction.

30. The method of claim 29, wherein the printhead has a substantially equal speed in said moving steps.

31. The method of claim 29, wherein said calculating step is dependent upon a speed of the printhead during said moving steps.

32. A method of identifying an ink type in an ink jet printer, said method comprising the steps of:

jetting ink onto a test surface providing a test pattern surface having a plurality of areas, selected nozzle of the ink jet printhead;

emitting light onto the ink wherein the ink was actually jetted onto the test surface during said identifying step;

measuring at least one characteristic of light reflected off of the ink; and determining the ink type based on the at least one characteristic of the respective area.

33. The method of claim 32, wherein the at least one characteristic includes an intensity of the light.

34. A method of detecting at least one missing nozzle in an ink jet printhead, said method comprising the steps of:

attempting to jet ink onto a test surface with a selected nozzle of the ink jet printhead;

using an optical device to detect whether the ink was actually jetted onto the test surface during said attempting step; and determining whether the selected nozzle is missing based upon a result of said detecting.

35. A method of detecting at least one missing nozzle in an ink jet printhead having a plurality of nozzles, said method comprising the steps of:

providing a test surface having a plurality of areas, each of the areas corresponding to a respective one of the nozzles;

attempting to jet ink onto each of the areas with the respective nozzles;

using an optical device to detect whether the ink was actually jetted onto each of the areas during said attempting step; and determining whether at least one said nozzle is missing based upon a result of said detecting.

36. The method of claim 35, wherein said areas are transparent, said optical device comprising a light source and a light detector on opposite sides of the test surface, said using step including detecting whether light is emitted through any of the areas.

37. The method of claim 35, wherein said using step includes:

ascertaining whether the ink was actually jetted onto a first of the areas during said attempting step; and repeating said ascertaining step for each remaining said area individually.

38. The method of claim 37, wherein said optical device includes a light source and a light detector, said using step includes scanning at least one of said light source and said light detector across said areas.

39. The method of claim 38, wherein said using step includes scanning said light detector across said areas.

40. The method of claim 39, wherein said attempting step includes scanning the printhead in a scan path across the test surface, said light detector substantially following the scan path of the printhead.

41. A method of detecting at least one missing nozzle in an ink jet printhead having a plurality of nozzles, said method comprising the steps of:

providing a test surface have a predetermined region;

using an optical detector to detect an intensity of light being one of reflected off of and emitted through the region;

attempting to jet ink from one of the nozzles onto a respective area within the region;

using said optical detector to detect a change in the intensity of light being one of reflected off of and emitted through the region, said light intensity change being a result of said attempting step; and determining whether said one nozzle is missing based upon the light intensity change.

42. The method of claim 41, wherein each of said attempting step, said second using step, and said determining step are repeated for each remaining one of the nozzles.

43. The method of claim 41, wherein said optical detector detects a change in the intensity of light being emitted through the region.

* * * * *